US011272285B2

(12) United States Patent
Calmel

(10) Patent No.: US 11,272,285 B2
(45) Date of Patent: Mar. 8, 2022

(54) LOW INERTIA SPEAKER

(71) Applicant: DEVIALET, Paris (FR)

(72) Inventor: Pierre-Emmanuel Calmel, Le Chesnay (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 16/937,069

(22) Filed: Jul. 23, 2020

(65) Prior Publication Data

US 2021/0037314 A1 Feb. 4, 2021

(30) Foreign Application Priority Data

Jul. 29, 2019 (FR) ..... 1908614

(51) Int. Cl.
*H04R 1/28* (2006.01)
*H04R 9/06* (2006.01)

(52) U.S. Cl.
CPC ..... *H04R 1/2834* (2013.01); *H04R 9/066* (2013.01)

(58) Field of Classification Search
CPC ..... H04R 9/063; H04R 9/066; H04R 9/027; H04R 1/2834; H04R 2400/11
See application file for complete search history.

(56) References Cited

U.S. PATENT DOCUMENTS 5,757,946 A * 5/1998 Van Schyndel ..... H04R 9/027 381/396
7,729,504 B2 * 6/2010 Tsuda ..... H04R 9/041 381/415

FOREIGN PATENT DOCUMENTS

EP 1274275 A1 1/2003
WO 1996013960 A1 5/1996

OTHER PUBLICATIONS

"Fluid Has World's Highest Magnetic Flux Density," Jee Journal of Electronic Engineering, Dempa Publications Inc., Tokyo, JP, vol. 27, No. 280, Apr. 1, 1990, pp. 64-66.
INPI Rapport de Recherche Préliminaire for Patent Application No. FR 1908614, Mar. 20, 2020, 2 pp.

* cited by examiner

*Primary Examiner* — Sunita Joshi
(74) *Attorney, Agent, or Firm* — Soquel Group LLC

(57) ABSTRACT

A speaker including a supporting structure, a diffusion membrane that is movable relative to the supporting structure, a motor for actuating the diffusion membrane, including a movable unit relative to the supporting structure, the movable unit being mechanically connected to the diffusion membrane for synchronized movement thereof, and a hydraulic circuit interposed between the movable unit and the diffusion membrane, the diffusion membrane and the movable unit each including a movable piston surface, interacting with a fluid of the hydraulic circuit.

11 Claims, 8 Drawing Sheets

LOW INERTIA SPEAKER

FIELD OF THE INVENTION

The present invention relates to a speaker, of the type including a supporting structure, a diffusion membrane that is movable relative to the support structure and a motor for actuating the diffusion membrane including a movable unit relative to the supporting structure, the movable unit being mechanically connected to the diffusion membrane for the synchronized movement thereof.

BACKGROUND

In a speaker, the diffusion membrane is generally rigidly connected to a movable unit of an actuating motor. This unit is often formed by an excitation coil movable in a magnetic circuit secured to the supporting structure of the speaker.

The coil is rigidly connected to the membrane. The membrane and the coil move jointly under the action of the electromagnetic force applied to the coil. A reaction force of equal intensity and opposite direction forms on the supporting structure of the speaker, which results in causing this structure to move in the opposite direction to the movement of the membrane.

These opposite movements are harmful to the proper working of the speaker.

Earlier documents, in particular document U.S. Pat. No. 4,547,663, have proposed a speaker in which the membrane and the excitation coil are coupled to one another by a lever articulated on the supporting structure. The articulation points of the membrane and the coil are arranged on the same side of the articulation point on the supporting structure. The coil and the membrane therefore move in the same direction. However, the movement of the coil is reduced relative to that of the membrane, reducing the total force applied on the supporting structure.

The connection between the membrane and the coil, provided by a lever, is very complex to produce in practice, since the lever ensures a rotational movement while the membrane and the coil must move in translation. This requires using a complicated connecting rod mechanism to convert the rotational movement into a translational movement.

This arrangement is detrimental to the energy yield of the speaker and the acoustic performance thereof.

SUMMARY

The invention aims to propose a speaker for which the forces on the supporting structure are reduced and the energy yield and acoustic quality are good.

To that end, the invention relates to a speaker of the aforementioned type, wherein it includes a hydraulic circuit interposed between the movable unit and the membrane, the membrane and the movable unit each including a movable piston surface, interacting with a fluid of the hydraulic circuit.

According to specific embodiments, the speaker includes one or more of the following features:

- the actuating motor includes an excitation coil borne by the movable unit and a magnetic field establisher for establishing a magnetic field, wherein the excitation coil is mounted movably;
- the actuating motor includes at least one magnet borne by the movable unit;

- the diffusion membrane is borne by the movable unit and is slidably guided relative to the movable unit;
- the piston surfaces of the movable unit on the one hand and of the membrane on the other hand are of revolution and/or are concentric;
- the diffusion membrane and the movable unit are movable in a synchronized manner in opposite directions under the action of the hydraulic circuit;
- the movable piston surfaces interacting with the hydraulic fluid of the diffusion membrane and the movable unit are configured such that the ratio of the rectilinear movement of the diffusion membrane to the rectilinear movement of the movable unit is negative or strictly greater than 1;
- the transformation ratio is substantially equal in absolute value to the ratio of the moving mass of the movable unit to the moving mass of the diffusion membrane;
- the hydraulic fluid is a ferrofluid; and
- the speaker includes two movable diffusion membranes, each diffusion membrane including a piston surface interacting with the same hydraulic fluid of the same hydraulic circuit.

The invention also relates to an acoustic playback equipment item including an amplifier and a speaker as defined above.

BRIEF DESCRIPTION OF THE DRAWINGS

The invention will be better understood upon reading the following description, provided solely as an example and done in reference to the drawings, in which.

DETAILED DESCRIPTION

Figure 1:
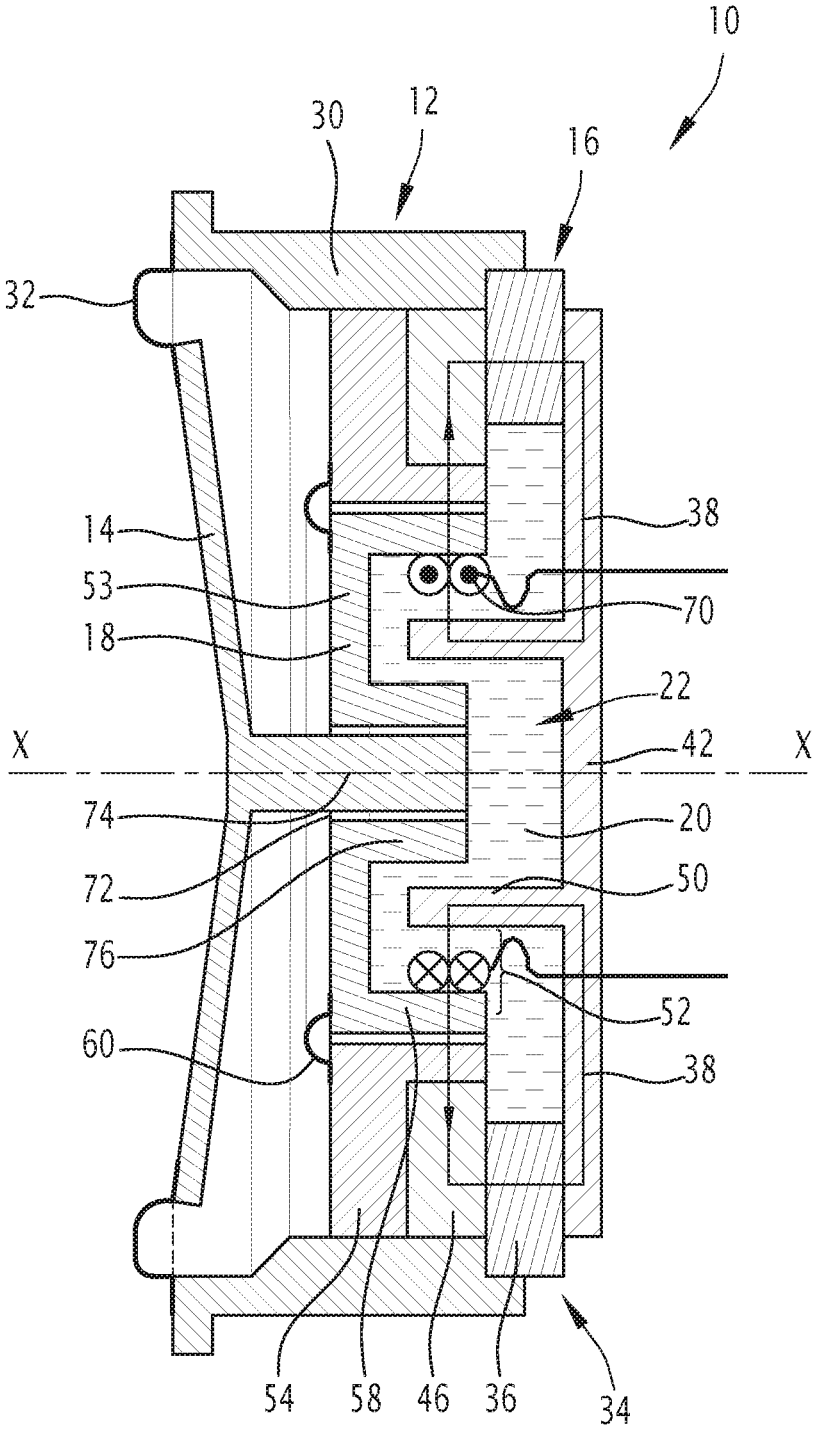
FIGS. 1, 2 and 3 are longitudinal sectional views of a same speaker according to the invention respectively at rest and in extreme movement positions of the membrane.
Figure 2:
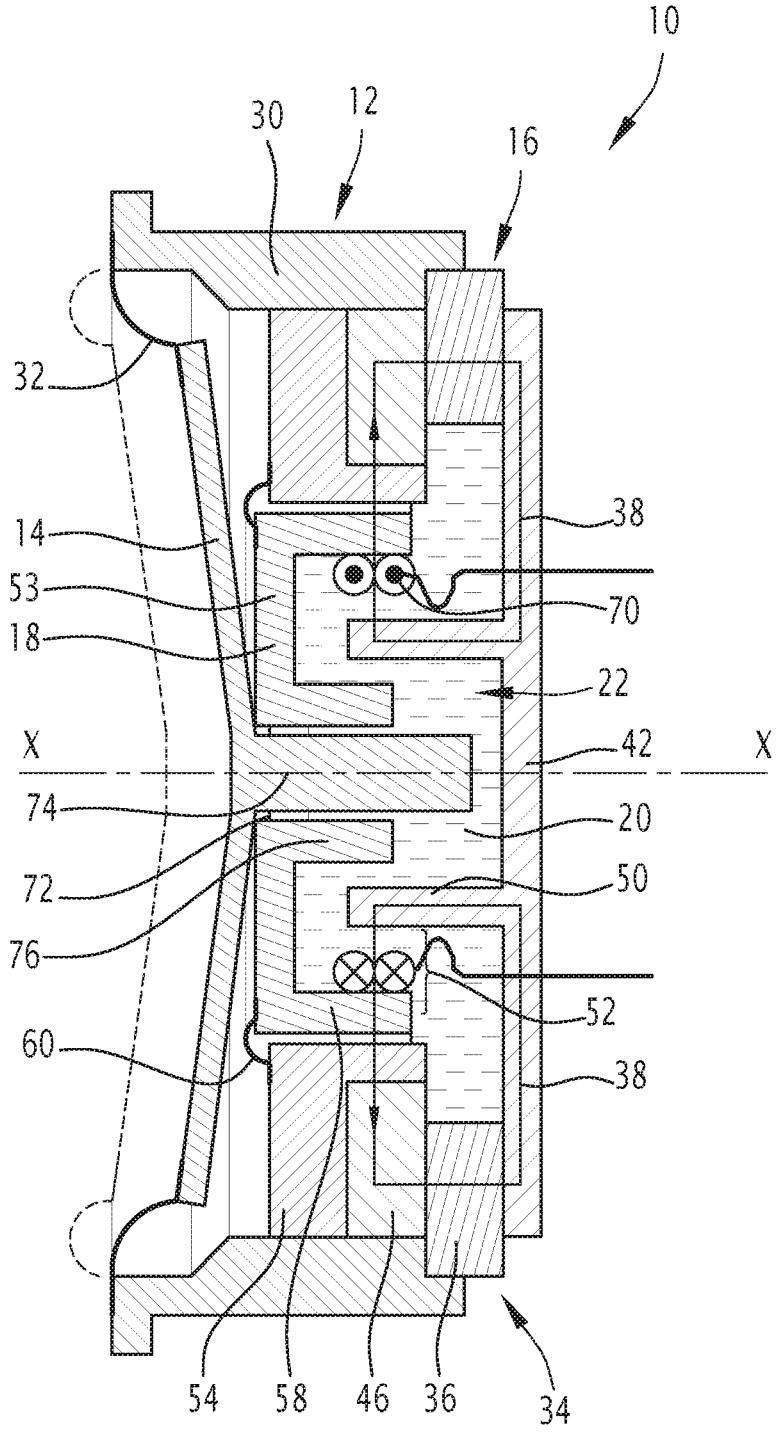
Figure 3:
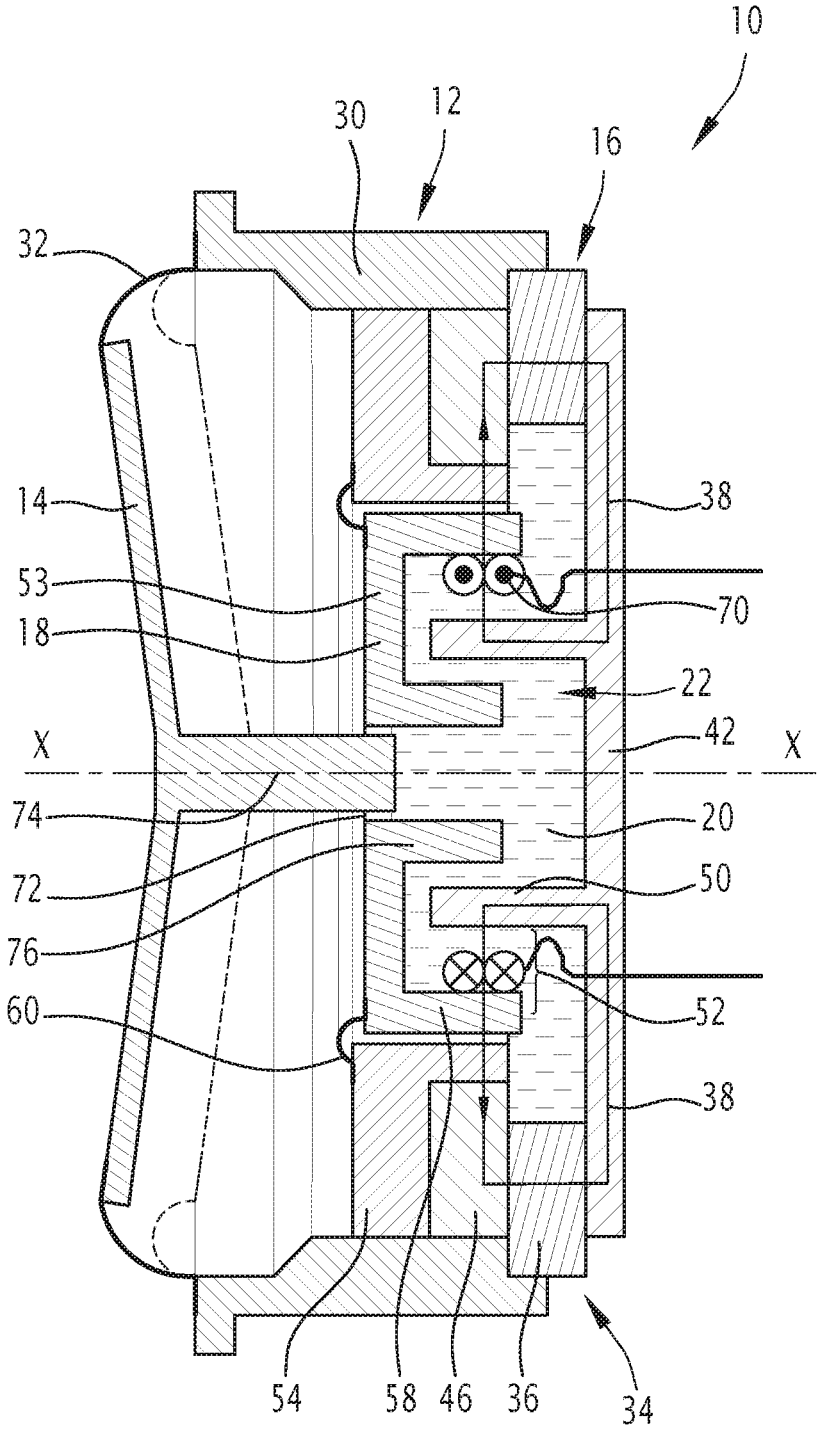

As illustrated in FIGS. 1 to 3, an electroacoustic speaker 10 according to the invention is generally of revolution about an axis X-X.

It includes a supporting structure 12 and a diffusion membrane 14 movable relative to the supporting structure 12 under the action of an actuating motor 16 integrated into the supporting structure. The actuating motor 16 includes a movable unit 18 mechanically connected to the diffusion membrane 14 for the synchronized movement thereof.

The actuating motor 16 includes a tight chamber 20 delimited between the supporting structure 12, the movable unit 18 and the membrane 14. It is filled with a hydraulic liquid 22 thus forming a hydraulic circuit. The movable unit 18 as well as the diffusion membrane 14 each delimit walls of the cavity 20 that form movable piston surfaces in contact with the hydraulic liquid 22.

The hydraulic liquid 22 has a density at least 10 times greater than that of air. It is in particular an oil. Advantageously, this liquid is a ferromagnetic liquid. To that end, it includes suspended particles, these particles containing iron and being specific to the transmission of a magnetic field.

The supporting structure 12 includes a shroud 30 delimiting a basket assembly at one end of which the membrane 14 is engaged coupled at its periphery to the shroud by a deformable annular gasket 32 ensuring the tightness and the maintenance of the membrane 14 in its resting position.

At its other end, the shroud 30 bears the motor 16, which includes a carcass 34 incorporating an annular magnet 36. This carcass delimits a toroidal magnetic circuit identified by the arrow 38 through which the movable unit 18 is movably mounted.

The carcass 34 delimits, with the movable unit 18 and the membrane 14, the chamber 20 filled with hydraulic liquid.

The carcass 34 has a base 42 formed by a disc against the inner surface of which the annular magnet 36 is kept at its periphery. The annular magnet 36 is interposed between the base 42 and a washer 46. Together they form the magnetic circuit 38.

The base 42 has, on its inner face, a shroud 50 centered on the axis X-X and extending across from the inner surface of the washer 46 with which it delimits a radial airgap denoted 52.

The movable unit 18 includes an annular structure 53, mounted slidably moving along the axis X-X in the airgap 52.

To that end, a liner 54 covers the inner surface of the washer 46 and its face facing toward the membrane 14.

The annular structure 53 of the movable unit includes, at its periphery, a skirt 58 mounted slidably moving in the liner 54 according to a tight connection. A resiliently deformable guide gasket 60 is arranged between the liner 54 and the movable unit 18.

The movable unit 18 includes, on its annular structure 53, a winding 70 arranged on the skirt 58 in the airgap 52. This winding is coupled by flexible conductors passing through the base 42 to an excitation source such as an audio amplifier.

The annular structure 53 of the movable unit has an axial passage 72 in which is received, slidably movably, a cylindrical core 74 forming an axial extension of the membrane 14. This passage 72 is bordered by an inner guide skirt 76 in which the core 74 slides with a tight fit ensuring the tightness.

It will be understood that with such a speaker, during a current variation in the winding 70, the movable unit 18 is moved axially by the Laplace force resulting from the circulation of the electric current in the winding itself placed in a magnetic field.

The movable unit 18 moves either toward the membrane as illustrated in FIG. 2, or away from the membrane as illustrated in FIG. 3 in the variation direction of the current in the winding.

Under the action of the movement of the movable unit 18, the hydraulic liquid 20 is suctioned or compressed under the action of the piston surface of the movable unit 18 perpendicular to the axis X-X and in contact with the hydraulic liquid.

The movement of the incompressible hydraulic liquid causes a suction of the core 40 of the membrane as illustrated in FIG. 2 or an ejection of this core as illustrated in FIG. 3, causing the movement of the membrane 14 either toward the movable unit 18 like in FIG. 2 or, on the contrary, away from the movable unit 18 like in FIG. 3. The movable unit 18 and the membrane 14 then move in opposite directions.

The area of the piston surface of the movable unit in contact with the hydraulic fluid is equal to $\pi(d_1^2-d_2^2)/4$ with $d_2$: outer diameter of the movable unit 18 and $d_1$: diameter of the core 74 of the membrane. It is advantageously greater than the area of the piston surface of the membrane 14 in contact with the hydraulic liquid 22, this area being equal to $\pi d_1^2/4$.

Thus, the axial movement of the movable unit 18 is less than the corresponding axial movement of the membrane 14 along this same axis X-X.

Advantageously, the areas of the piston surfaces of the membrane 14 and the movable unit 18 are such that the ratio of the area of the piston surface of the movable unit 18 to the area of the piston surface of the membrane 14 is equal to the ratio of the moving mass M14 of the membrane to the moving mass M18 of the moving unit, that is to say:

$$\frac{(d_2^2 - d_1^2)}{d_1^2} = \frac{M14}{M18} \tag{1}$$

With such a dimensioning, the center of gravity of the speaker 10 remains fixed along the axis X-X irrespective of the position of the membrane 14 and the movable unit 18, thus preventing any movement of the speaker as a whole during its operation.

The transformation ratio μ in such a speaker is defined by the ratio of the axial movement along the axis X-X of the membrane 14 to the axial movement of the movable unit 18.

Advantageously, the transformation ratio is negative, thus allowing at least a partial compensation between the inertial forces of the membrane 14 and the movable unit 18.

Advantageously, rigid materials are used to form the elements delimiting the hydraulic circuit 22 and the hydraulic liquid 20 is incompressible. The transformation ratio μ is then independent of the frequency played back by the speaker.

In a variant, the hydraulic liquid is compressible, while for example being formed by oil and gas dissolved in the oil and/or one of the elements delimiting the hydraulic circuit 22 is flexible, the core 40 for example being formed by a cylindrical block of axially resiliently deformable polymer. The transformation ratio μ is then variable based on the frequency played back by the speaker and based on the position of the membrane.

Figure 4:
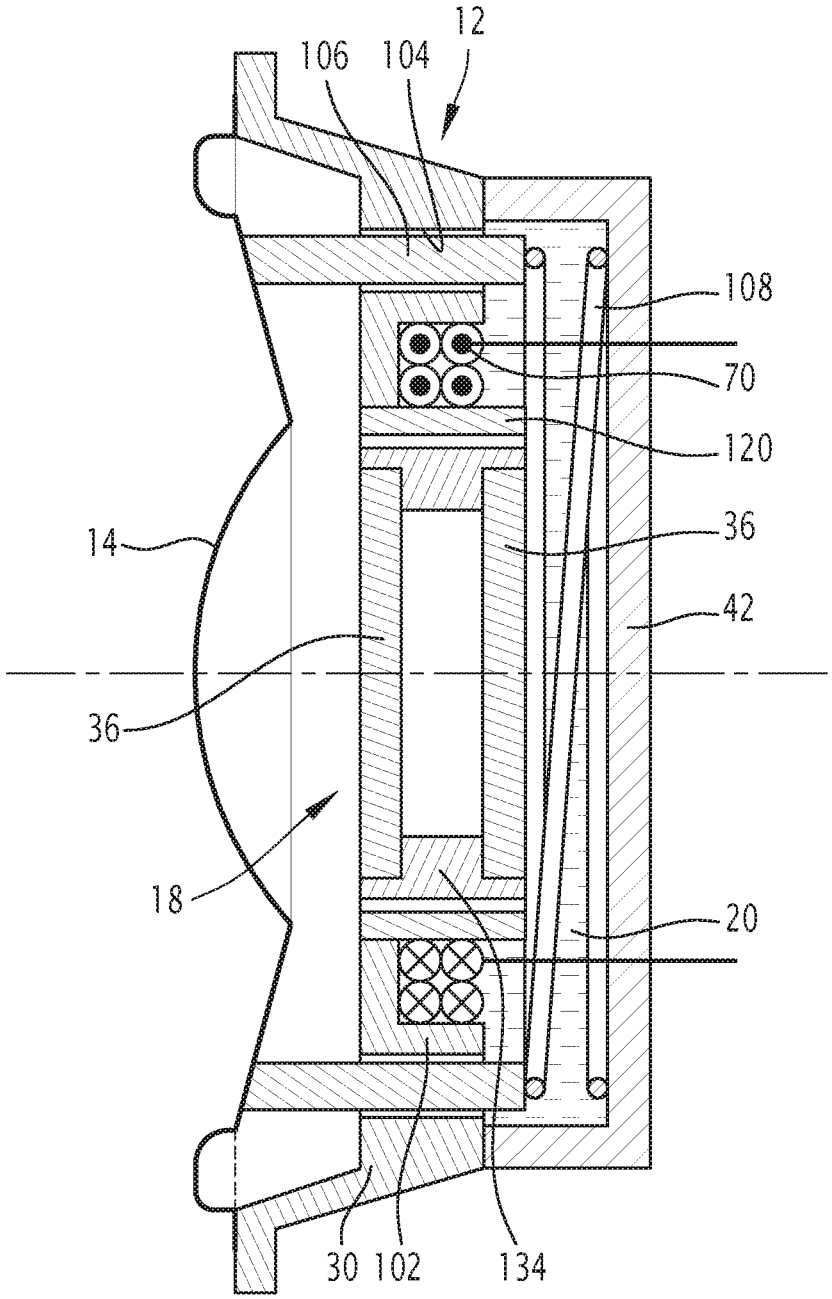
FIG. 4 is a view identical to that of FIG. 1 of a variant embodiment of the speaker at rest.

FIG. 4 shows a variant embodiment, in which the elements identical or corresponding to those of the preceding embodiment are designated by the same reference numbers.

The movable unit 18 here is formed by an assembly of magnets 36 that are movable relative to the supporting structure 12 while the winding 70 is secured to the supporting structure 12.

The membrane 14 is guided relative to the supporting structure 12 and no longer relative to the movable unit 18.

More specifically, the base 42, which extends the skirt 30 forming the basket assembly at one of its ends, has a basin shape. It inwardly delimits the cavity 20.

The skirt 30 includes an inner rim 102 providing the support for the winding 70, the guiding of the membrane 14, the guiding of the movable unit 18.

This inner rim 102 has bores 104 that are angularly evenly distributed about the axis X-X in which slides 106 are received that are formed by rods parallel to the axis X-X guided in sliding in the bores 104. These rods are secured to the membrane 14 at the periphery thereof.

A tight fit between the slides 106 and the bores 104 ensures the tightness with respect to the hydraulic liquid 20.

A helical spring 108 is compressed between the base 42 and the free end of the slides 106 in order to keep the membrane 104 in a predetermined resting position when there is no current circulating in the winding 70.

The rim 102 delimits an annular shoulder in which the winding 70 is kept fixed. The winding 70 is immobilized relative to the fixed structure of the speaker.

The rim 102 inwardly has a liner 120 in which the movable unit 18 is mounted sliding along the axis X-X according to a tight arrangement that is tight with respect to the hydraulic liquid 22.

The movable unit 18 formed by an assembly of magnets is made up of two magnets 36 in the form of discs arranged with their polarities opposite along the axis X-X. These magnets are connected to one another and kept fixed in position relative to one another by a peripheral nonmagnetic shroud 134. The latter slides in the liner 120. The assembly of magnets is thus along the winding axis 70.

In this embodiment, during the establishment of a variable current in the coil 70, the movable unit 18 formed by the assembly of magnets is made to move along the axis X-X, causing a corresponding movement of the hydraulic liquid 22. The liquid acts on the piston surface formed at the end of the slides 106 to cause the membrane 14 to move in the opposite direction.

Like before, the ratio of the piston surface areas of the membrane 14 and the movable unit in contact along the axis X-X with the hydraulic liquid defines the transformation ratio μ between the axial movements of the membrane 14 and the movable unit 18.

Advantageously, this transformation ratio is greater than 1 in absolute value, through the choice of the piston surface areas allowing a greater axial movement of the membrane 14 than of the movable unit 18.

Figure 5:
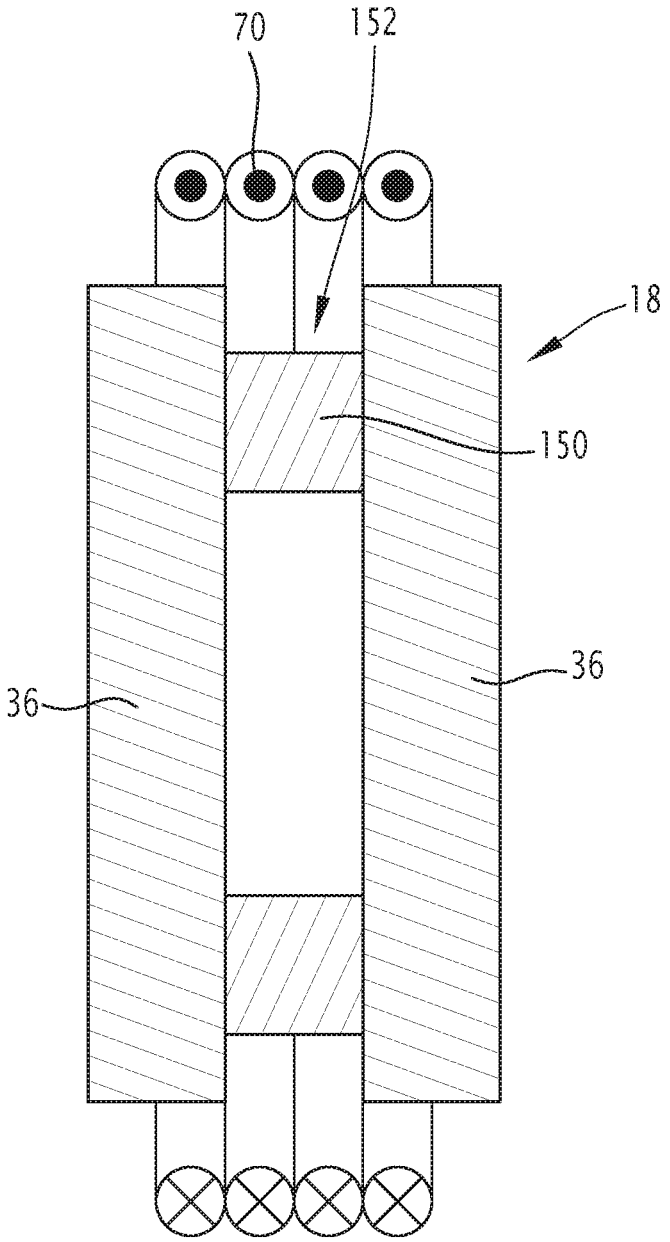
FIGS. 5 and 6 are schematic longitudinal sectional views of the arrangement of the movable magnet and the fixed winding according to two variant embodiments of the embodiment of FIG. 4.

FIG. 5 shows a variant embodiment of the movable unit 18. The peripheral shroud 13 is replaced by an annular magnet 150, the magnetic field of which is oriented radially, thus increasing the value of the total radial magnetic field.

The movable unit has a shape similar to that of FIG. 4, but the diameter of the annular magnet 150 is smaller than the diameter of the disc-shaped magnets 36 such that an annular space 152 is arranged between the magnets at the periphery of the movable unit.

Figure 6:
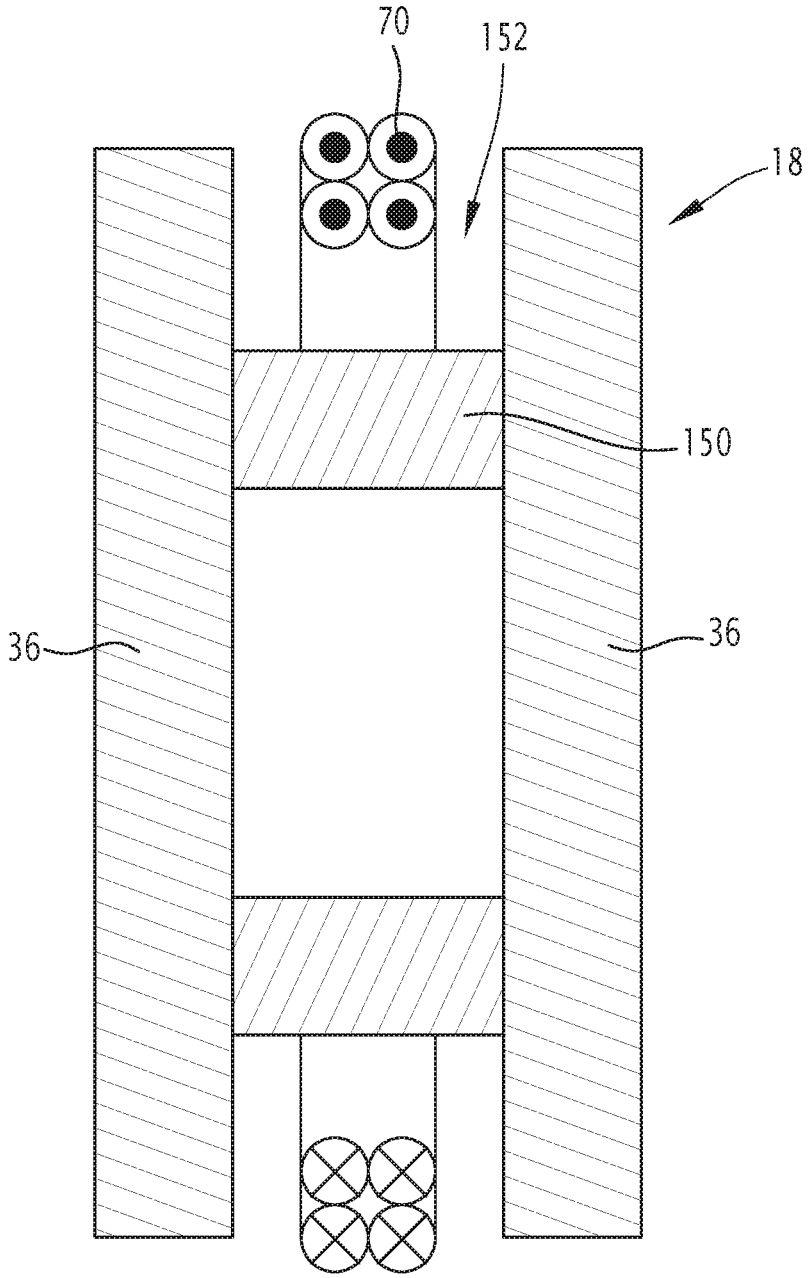

Advantageously, in the embodiment of FIG. 6, the winding 70 is offset to the inside of this annular space 152 while being kept fixed relative to the supporting structure of the speaker. This arrangement, although it limits the axial travel of the movable unit 18 to the axial space defined between the winding 70 and the magnets 36 allow a radially compact arrangement of the speaker.

Furthermore, the small axial movement of the movable unit 18 much smaller than that of the membrane 14 due to a transformation ratio much greater than 1 in absolute value makes it possible to use only a small axial space between the winding 70 and the magnets 36.

In a variant not shown of the arrangement of FIGS. 4, 5 and 6, the assembly of magnets formed by two disc-shaped magnets coupled by a shroud, which form or not a magnet, is pierced with an axial bore through which a core 40 of the membrane 14 is received, like in the embodiment of FIG. 1. The guiding of the membrane is then done like in the embodiment of FIG. 1 between the movable unit and the membrane. The slides 106 are then eliminated.

Figure 7:
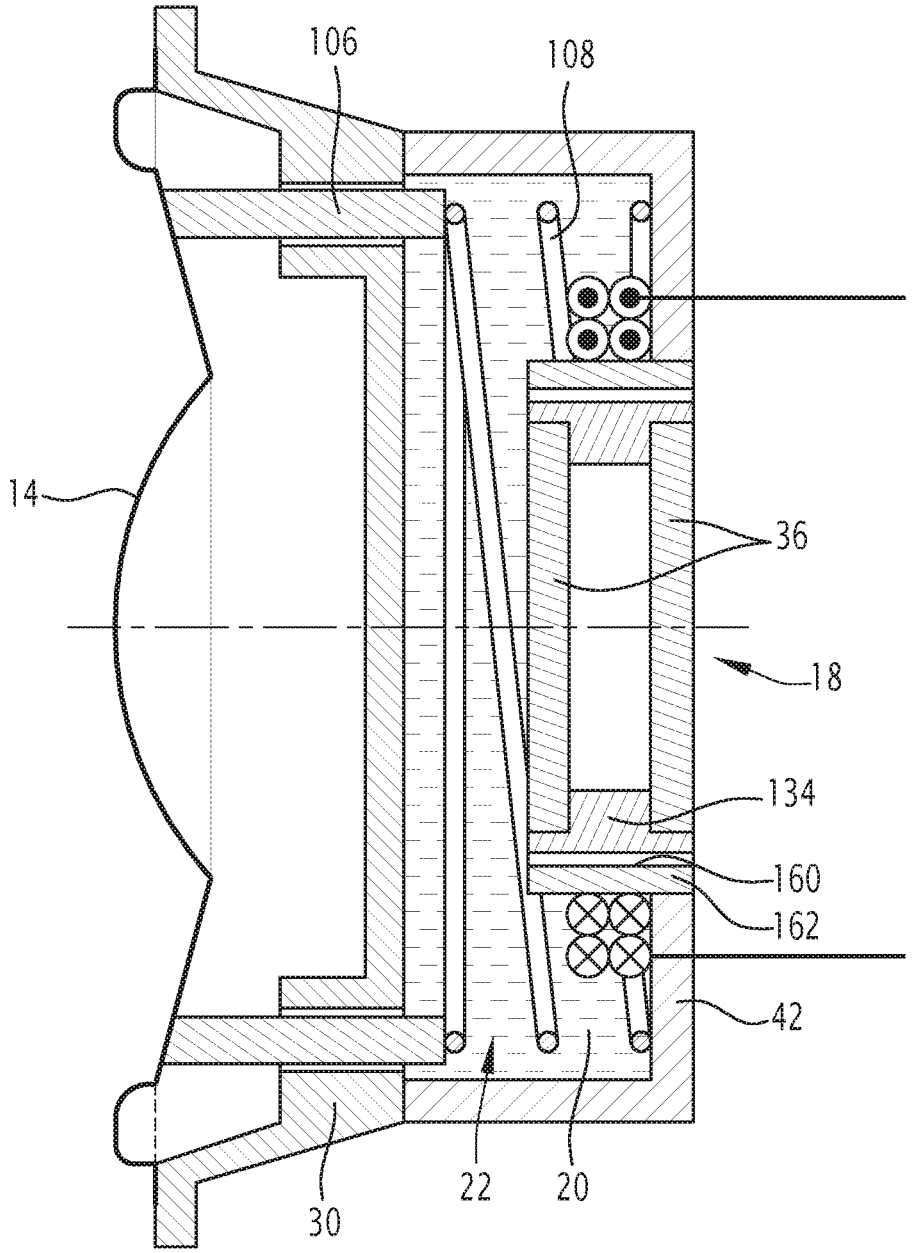
FIGS. 7 and 8 are views identical to that of FIG. 1 of the still two other variant embodiments of a speaker according to the invention.

FIG. 7 shows a variant embodiment of the speaker of FIG. 4 in which the movable unit 18, also formed by an assembly of magnets, as well as the winding 70 are arranged at the base 42 and no longer on the rim 102. This rim forms a continuous web over the entire transverse surface of the skirt 30 in order to delimit the chamber 20.

Here, the base bottom 42 is pierced with an axial bore 160 bordered by an inner skirt 162 ensuring tight guiding of the movable unit 18. The winding 70 is fastened against the skirt 162.

In this embodiment, the membrane 14 and the movable unit 18 move in the same synchronism direction. Thus, the transformation ratio μ is strictly greater than 1, thus reducing the movement of the movable unit 18, which is heavy relative to that of the membrane 14, which is light.

Thus, advantageously, more generally, the transformation ratio is either negative, like in the preceding embodiments, or strictly greater than 1.

Figure 8:
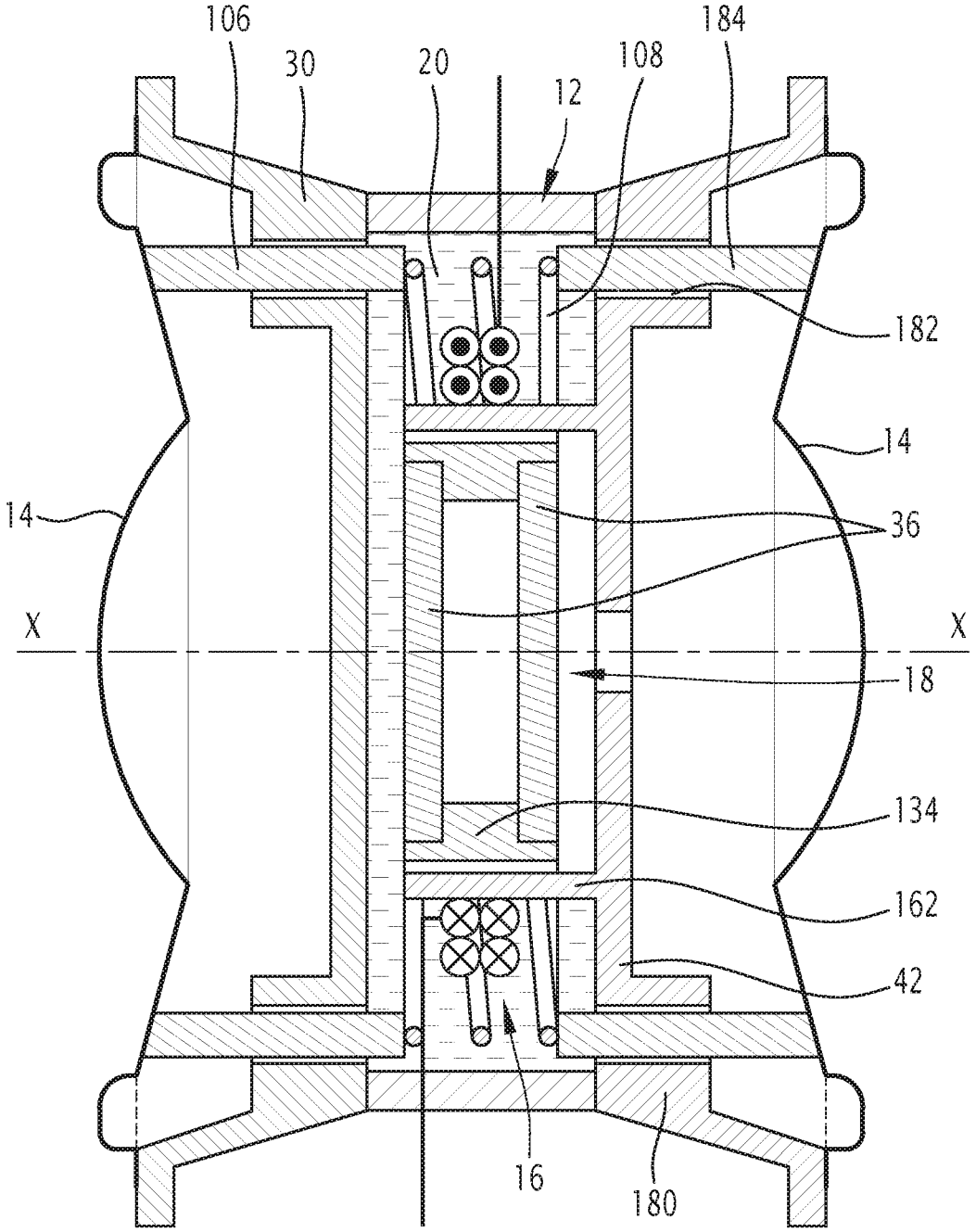

In the embodiment of FIG. 8, the elements that are identical or correspond to those of the preceding embodiments are designated using the same reference numbers.

In these embodiments, the speaker includes two membranes 14A, 14B both movable along the axis X-X and arranged on either side of the supporting structure 12. These membranes are movable simultaneously in opposite directions under the action of a single actuating motor 16.

In the figure, in the left part, the speaker copies the arrangement of the speaker of FIG. 7 with the membrane denoted 14A. Here, the base 42 is outwardly extended by a shroud 180 in order to form a basket assembly for retaining the second membrane 14B. This shroud 180 here is integral with the skirt 162, that is to say they are formed in a single block. It is pierced with bores 182 for the tight passage of slides 184 emerging in the cavity 20 containing the hydraulic liquid and extending the membrane 14B. The spring 108 defining the resting position of the two membranes 14A, 14B is applied on the end surfaces of the slides 184 and 106.

In this embodiment, like before, the circulation of a current in the winding 70 causes a movement of the movable unit 18, which causes the joint movement in opposite directions of the slides 106 and 184 respectively controlling the two opposite membranes 14A and 14B.

The invention claimed is:

1. A speaker comprising:

a supporting structure;

a diffusion membrane that is movable relative to said supporting structure;

a motor for actuating said diffusion membrane, comprising a movable unit relative to said supporting structure, the movable unit being mechanically connected to said diffusion membrane for synchronized movement thereof; and a hydraulic circuit interposed between said movable unit and said diffusion membrane, said diffusion membrane and said movable unit each comprising a movable piston surface, interacting with a fluid confined in the hydraulic circuit.

2. The speaker according to claim 1, wherein said motor comprises:

an excitation winding borne by said movable unit; and a magnetic field establisher establishing a magnetic field, wherein said excitation winding is mounted movably.

3. The speaker according to claim 1, wherein said motor comprises at least one magnet borne by said movable unit.

4. The speaker according to claim 1, wherein said diffusion membrane is borne by said movable unit and is slidably guided relative to said movable unit.

5. The speaker according to claim 4, wherein the piston surfaces of said movable unit and said diffusion membrane are of revolution and/or are concentric.

6. The speaker according to claim 1, wherein said diffusion membrane and said movable unit are movable in a synchronized manner in opposite directions under action of said hydraulic circuit.

7. The speaker according to claim 1, wherein said movable piston surfaces interacting with the hydraulic fluid of said diffusion membrane and said movable unit are configured such that a transformation ratio of the rectilinear movement of said diffusion membrane to the rectilinear movement of said movable unit is negative or strictly greater than 1.

8. The speaker according to claim 7, wherein the transformation ratio is substantially equal in absolute value to the ratio of the moving mass of said movable unit to the moving mass of said diffusion membrane.

9. The speaker according to claim 1, wherein the fluid of said hydraulic circuit is a ferrofluid.

10. The speaker according to claim 1, comprising two movable diffusion membranes, each diffusion membrane comprising a piston surface interacting with the hydraulic fluid of said hydraulic circuit.

11. An acoustic playback equipment item comprising:

an amplifier; and a speaker according to claim 1.

* * * * *